United States Patent [19]

Hollan et al.

[11] 4,234,044

[45] Nov. 18, 1980

[54] CHEMICAL AGENT INJECTION SYSTEM FOR FIRE FIGHTING EQUIPMENT

[75] Inventors: Mark E. Hollan; John J. Bayles, both of Oxnard, Calif.

[73] Assignee: The United States of America as represented by the Secretary of the Navy, Washington, D.C.

[21] Appl. No.: 946,003

[22] Filed: Sep. 27, 1978

[51] Int. Cl.[2] ..... A62C 35/00

[52] U.S. Cl. ..... 169/14; 137/99

[58] Field of Search ..... 169/14, 15, 16, 44, 169/5, 6; 239/569; 137/99, 566, 567, 3, 7; 261/DIG. 26

[56] References Cited

U.S. PATENT DOCUMENTS

| | | | |
|---|---|---|---|
| 2,989,123 | 6/1961 | Holmes | 169/14 |
| 3,115,158 | 12/1963 | Sheppard | 169/14 |

*Primary Examiner*—Kenneth W. Noland

*Attorney, Agent, or Firm*—Richard S. Sciascia; Joseph M. St.Amand

[57] ABSTRACT

A fire fighting pump apparatus adapted for remote control wherein a chemical additive is injected into the system and utilized in conjunction with water. The device is provided with an automatic self-cleaning circuit wherein water can circulate through the chemical agent injection pump, and the system is also so designed that the chemical agent injection pump will not be inadvertently operated dry.

8 Claims, 1 Drawing Figure

CHEMICAL AGENT INJECTION SYSTEM FOR A FIRE FIGHTING SYSTEM WITH STANDOFF REMOTE OPERATIONS CAPABILITY.

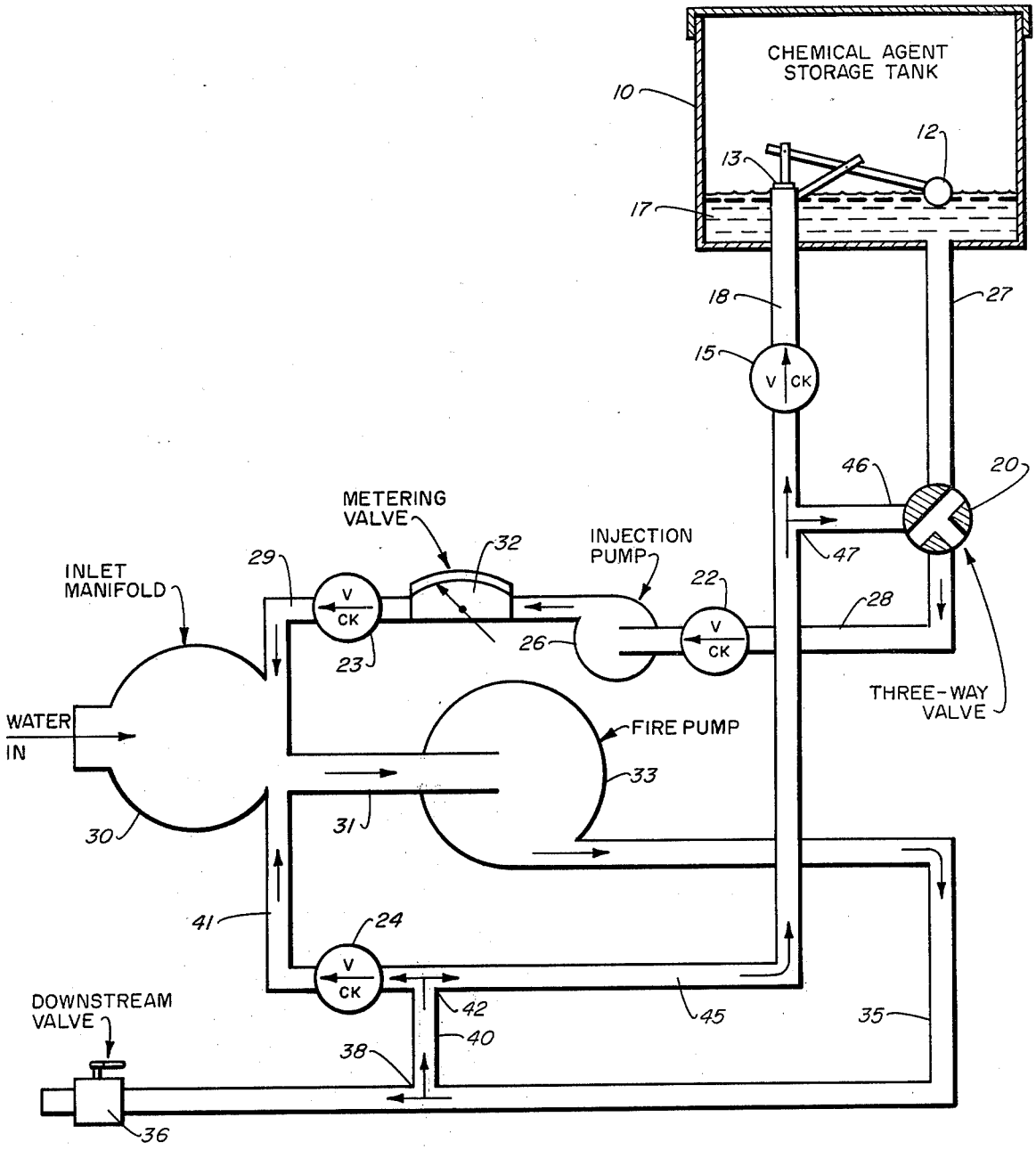
CHEMICAL AGENT INJECTION SYSTEM FOR A FIRE FIGHTING SYSTEM WITH STANDOFF REMOTE OPERATIONS CAPABILITY.

CHEMICAL AGENT INJECTION SYSTEM FOR FIRE FIGHTING EQUIPMENT

CROSS-REFERENCED APPLICATIONS

This invention is related to the commonly owed copending application Ser. No. 945,984 for MODULAR CONTAINERIZED FIREFIGHTING SYSTEM WITH REMOTE STANDOFF CAPABILITY, filed on Sept. 27, 1978, together herewith and now abandoned.

BACKGROUND

The present invention relates to firefighting systems in general and particularly to a means by which chemical agent additives can be successfully applied to a fire by remotely controlled equipments.

There are a number of situations in which firefighting is extremely difficult, if not impossible, with conventional fire-fighting equipments such as moving a fire truck overland to the point of need, or in cases where no water supply mains exist. Examples are forest fires in rugged impassable terrain and forward area military air strips or pads under combat situations. Recent developments in the use of short takeoff and landing and helicopter craft have created requirements for remotely located refueling and resupply dumps. Fire fighting efforts in such situations can be enhanced by providing air transportable ground support equipments which can be quickly moved into a site or prepositioned. Such equipments should be designed to be transported swiftly from site to site. Loss of fuel and supplies due to fire in military situations can easily neutralize the combat readiness of a dependent force. In many situations, such as fuel dump, ammo dump, forest conflagration and toxic gas or chemical fires, extreme hazards are faced by fire fighting personnel. Within the civilian sector, extremely wide dispersal of luxurious housing and light industry into rural and "rustic" areas has occured. Therefore, a need exists for a remotely controlled fire fighting capability. This presents special problems when chemical agent additives are utilized in the fire suppressant (e.g., water).

Suppressants including chemical additives mixed in very small quantities with water greatly enhance the fire fighting capabilities of the water. There have been three ways in which these chemicals have been injected and mixed with the water: premixing in water storage containers; use of around-the-pump proportioners; and use of eductors. Each of these means has certain limitations which are not compatible with the highly mobile fire fighting system developed and discussed herein.

Premixing the chemicals with stored water is applicable particularly for wetting agents. However, some of the additives are corrosive and must be stored in special containers until required for use. Mixing by means of around-the-pump proportioners is suited to systems and situations with "unlimited" water sources and close supervision by experienced fire fighting personnel. Application by means of eductors which function on the venturi principle requires careful selection and matching of eductor size to the water stream flow rate and pressure. Eductors are also sensitive to pressure drop across the eductor and therefore placement is most effective at the nozzle end of the water stream.

Based upon the needs for fire protection in forward area combat situations a highly mobile fire fighting system featuring remote control of the placement of fire suppressants onto the fire has been developed.

The highly mobile fire fighting system incorporates two basic types of modules; water storage and mechanical equipment (pump and engine). The intended use for the system envisions long term storage of water supplies when prepositioned or for movement from site to site, and therefore, limits means for introduction of the corrosive chemical additives. Because of anticipated long-term water storage, permixing of chemical additives is not a practicable solution. The mechanical system includes a continuous recirculation bypass for fire pump cooling when valving downstream is closed intermittently. This would upset a chemical additive mixture proportioned by an around-the-pump system. The highly mobile fire fighting system incorporates a standoff fire fighting capability wherein the operator controls a fire nozzle transporter vehicle remotely, from distances up to 1,500 feet. This standoff distance is intentionally variable, and is determined by the number of 50 foot lengths of fire hose required to reach the fire objective. Consequently, utilization of eductors as the additive injection method also is not practicable. Because of the corrosive nature of the chemical additives, materials compatibility becomes a problem and cleaning up after use is essential.

SUMMARY

It is therefore a primary object of the present invention to provide a chemical agent injection system for a firefighting system with standoff remote operations capability. Another object of the invention is to provide a chemical agent injection pump system with automatic self-cleaning capabilities. A further object of the invention is to provide a chemical agent injection pump system that cannot be inadvertently operated dry.

The chemical agent injection system devised for the high mobile fire fighting system includes a corrosion resistant agent storage tank, a positive displacement pump, and operator controlled metering and shutoff valves. Because of the corrosive nature of the chemical agent the system also includes an automatic water flushing circuit to purge the storage tank and/or injection circuit when the injection of the chemical agent has been completed.

BRIEF DESCRIPTION OF THE DRAWING

The FIGURE of the drawing shows a schematic diagram of one embodiment of the chemical agent injection system according to the present invention.

DESCRIPTION

The storage tank 10, shown in the FIGURE of drawing, is filled with a chemical suppressant agent causing float 12 to rise and float valve 13 to close. Check valve 15 keeps the corrosive chemical agent 17, that may have entered pipe line 18 from the storage tank, from further entering the plumbing system until the float valve 13 closure is effected. Three way valve 20 is used to control flow of chemical agent from tank 10. Check valves 22, 23 and 24 allow fluids to flow only in one direction, as shown in the pipe lines. Three-way valve 20 is normally closed to the corrosive chemical agent until application of the agent is required, and then it is opened for feeding the chemical agent to injection pump 26. Pump 26 injects the chemical agent 17 from lines 27 and 28, via line 29, to water inlet manifold 30 when required. A metering valve 32 is utilized to ensure the proper injection rate for the chemical suppressant agent 17. Chemical injection rate is determined from tables based upon water delivery rate for various system pressures at the fire pump and the length of hose used. Injection pump 26 has a pressure shutoff switch and thus operates on demand.

Water is drawn into the system through the inlet manifold 30 and line 31 by the fire pump 33 where it is pressurized for delivery via pressure line 35 to the fire hose, not shown, through downstream valve 36. The pressurized water is divided at T-junction 38 where a portion of the water (or water and chemical mixture) from line 35 is recirculated via lines 40 and 41 and check valve 24 back through the water inlet manifold 30 and fire pump 33. When downstream valve 36 is closed for any reason, the pressurized water directed through inlet manifold 30 and fire pump 33 will act to cool the fire pump. The water through line 40 is also divided at T-junction 42 and a portion will flow through line 45 if either or both of the three-way valve 20 or float valve 13 are open. If three-way valve 20 is open to line 27 from the storage tank and closed to line 46 from T-junction 47 the flow will be in the direction of the arrows via lines 45 and 18 into tank 10 and from tank 10 via lines 27 and 28 to injection pump 26. When valve 20 is closed to line 27 and open to line 46 the flow will be via lines 45, 46 and 28 to injection pump 26, bypassing tank 10. In either case water can circulate through injection pump 26 back to the intake manifold 30. This provides an automatic purging circuit to cleanse the injection system of any corroding chemical agent residues when injection of the chemical agent has been completed. The operator who monitors the operation of the mechanical system module sets valves 20 and 32 according to specific needs.

Injection pump 26 will not be inadvertently operated dry because, with valve 20 set for flow from line 27, storage tank 10 will receive water via check valve 15 and line 18. With valve 20 set to shut off the flow from line 27, the pressurized water circuit is open to injection pump 26 via lines 40, 45, 46 and 28.

The principle advantages of this invention are that the system will permit effective and efficient application of chemical agents used in fire suppression, notably foaming agents, when utilized with fire fighting systems featuring remote control of the fire nozzle and that it includes an automatic self-cleaning circuit. Also, this system prevents the inadvertent dry operation of the injection pump. Other features of the system permit the operator to adjust or shut off the flow of chemical agent additive as operating and fire fighting requirements vary. This invention permits the one injection system to accommodate to the fire pump that may be operated over a wide range of water stream flow rates and pressures, and to accommodate various lengths of fire hose and consequent changes in line friction losses.

The manual metering valve 32 can be replaced with an automatic control valve sensing water flow rate, as an alternate embodiment if desired.

Obviously, other embodiments and modification of the present invention will readily come to those of ordinary skill in the art having the benefit of the teachings presented in the foregoing description and the drawing. It is therefore to be understood that this invention is not to be limited thereto and that these modifications and embodiments are intended to be included within the scope of the appended claims.

What is claimed is:

1. A chemical agent injection system for firefighting applications, comprising:

a. a water inlet manifold means operable to be connected to a water supply source;

b. a fire pump means having an inlet and an outlet and operable to pressurize water supplied thereto via said inlet and provide pressurized water via said outlet for downstream delivery;

c. the output of said water inlet manifold means being connected to said fire pump means inlet;

d. a chemical agent storage tank operable to supply a chemical agent that can be injected into water from said water supply source at said water inlet manifold means;

e. injection pump means connected via chemical agent conduit means between said chemical agent storage tank and said water inlet manifold means for pumping chemical agents from said storage tank into said water inlet manifold means when desired for mixture therewith with the water;

f. conduit means for transporting pressurized water together with any chemical agents injected therein from said fire pump means outlet downstream delivery point and to a means for recirculating back into the system;

g. said recirculated portion of water and any chemical agent being fed partially to said water inlet manifold means via a first recirculating conduit means and partially toward said storage tank via a second recirculating conduit means;

h. control means in conjunction with the second recirculating conduit means for selectively directing the flow of recirculating water through said storage tank to said injection pump means in a first mode of operation, and bypassing said storage tank with flow directly to said injection pump means in a second mode of operation; and i. said recirculating water passing through said storage tank and injection pump means operating to purge the system of chemical agents; said recirculating water delivered to said injection pump preventing inadvertent dry operation of the injection pump.

2. A device as in claim 1 wherein check valve means are provided to allow fluid flow only in one direction in said conduit means.

3. A device as in claim 1 wherein means is provided in said system which allow flow of water in only one direction.

4. A device as in claim 1 wherein means is provided for metering and controlling the amount of chemical agent injected into the system.

5. A device as in claim 1 wherein said injection pump is provided with pressure shutoff means and operates on demand.

6. A device as in claim 1 wherein said chemical agent storage tank is provided with valve means to prevent reverse flow of fluid from said storage tank into the system.

7. A device as in claim 1 wherein said control means in conjunction with the second recirculating conduit means comprises a three-way control valve.

8. A device as in claim 1 wherein said first recirculating conduit means is provided with a check valve means to prevent flow of fluid from said water inlet manifold through said first recirculating conduit means and transporting means to said downstream delivery point and said second recirculating conduit means.

* * * * *